United States Patent [19]

Gabrosek et al.

[11] Patent Number: 4,659,905

[45] Date of Patent: Apr. 21, 1987

[54] ELECTRIC BLANKET

[76] Inventors: Kenneth Gabrosek; George Spector, both of 233 Broadway RM 3615, New York, N.Y. 10007

[21] Appl. No.: 780,189

[22] Filed: Sep. 26, 1985

[51] Int. Cl.[4] ..... H05B 3/34

[52] U.S. Cl. ..... 219/212; 219/529; 219/486

[58] Field of Search ..... 219/211, 212, 217, 528, 219/529, 548, 549, 486, 200, 201

[56] References Cited

U.S. PATENT DOCUMENTS

| | | | |
|---|---|---|---|
| 3,668,367 | 6/1972 | Williams | 219/212 |
| 3,739,142 | 6/1973 | Johns | 219/212 |
| 4,162,393 | 7/1979 | Balboni | 5/421 |

FOREIGN PATENT DOCUMENTS

| | | | |
|---|---|---|---|
| 401202 | 5/1969 | Australia | 219/212 |
| 979851 | 5/1951 | France | 219/212 |
| 559495 | 2/1975 | Switzerland | 219/212 |

*Primary Examiner*—E. A. Goldberg
*Assistant Examiner*—Teresa Walberg

[57] ABSTRACT

An electric blanket for a person with arthritis and circulatory problems in their legs is provided having a control switch which is located at the top of the blanket for controlling an upper heating element disposed over the body of the person and a lower heating element disposed over the feet of the person so that heat can be supplied in various combinations to the body and feet of the person.

4 Claims, 5 Drawing Figures

FIG. 1
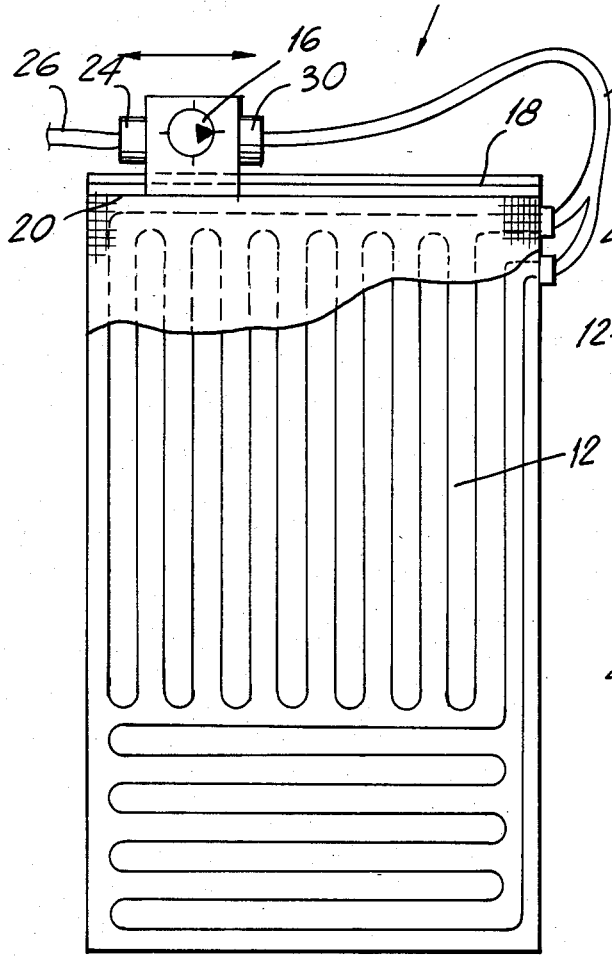
FIG. 5
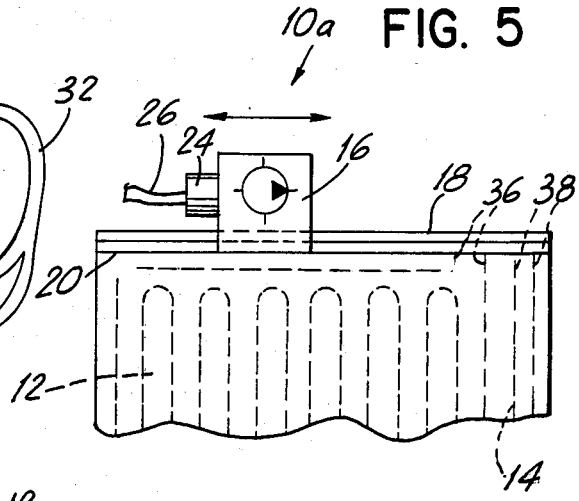
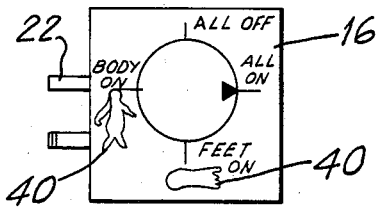
FIG. 2
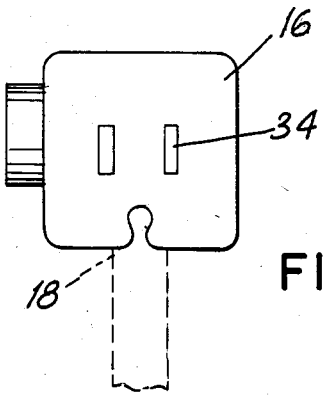
FIG. 3
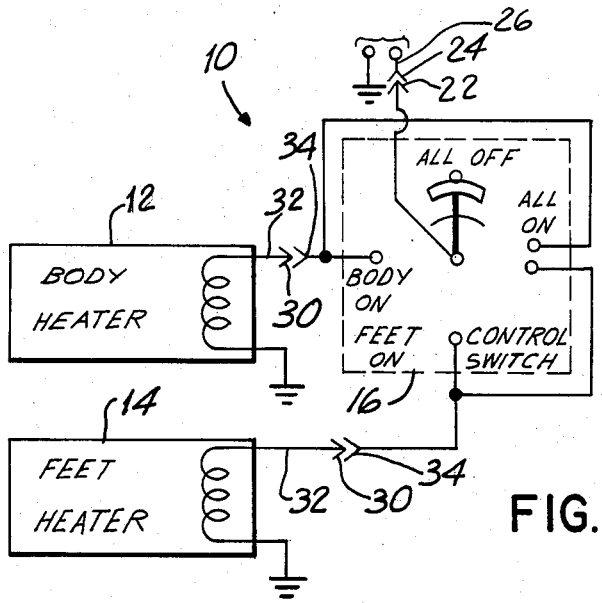
FIG. 4

ELECTRIC BLANKET

BACKGROUND OF THE INVENTION

The instant invention relates generally to thermally controlled bed coverings and more specifically it relates to an electric blanket for people with arthritis and circulatory problems in their legs.

Numerous thermally controlled bed coverings have been provided in prior art that are adapted to supply heat to persons in bed. For example, U.S. Pat. Nos. 3,072,776; 3,739,142 and 4,423,308 all are illustrative of such prior art. While these units may be suitable for the particular purpose to which they address, they would not be as suitable for the purposes of the present invention as heretofore described.

SUMMARY OF THE INVENTION

A principle object of the present invention is to provide an electric blanket for people with arthritis and circulatory problems in their legs that is equipped with a lower heating element disposed over the feet of a person and adapted for separate control.

Another object is to provide an electric blanket in which a control switch is located at the top of the blanket for controlling an upper heating element disposed over the body of a person and a lower heating element disposed over the feet of the person so that heat can be supplied in various combinations to the body and feet of the person.

An additional object is to provide an electric blanket in which the control switch is slideably adjustable along the top of the blanket for easy access by the person using the blanket.

A further object is to provide an electric blanket that is economical in cost to manufacture.

A still further object is to provide an electric blanket that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a top plan view with parts broken away of the invention.

FIG. 2 is an enlarged top plan view of the control switch.

FIG. 3 is an enlarged side view of the control switch.

FIG. 4 is a schematic diagram showing the electrical circuit.

FIG. 5 is a partial top plan view of a modification with internal wiring to the control switch through the slide track.

DETAILED DESCRIPTION OF THE PREFERRED EMBODIMENTS

Turning now descriptively to the drawings, in which similar reference characters denote similar elements throughout the several views, FIGS. 1 through 4 illustrates an electric blanket 10 for a person (not shown) with arthritis and circulatory problems in their legs.

The blanket 10 contains an upper heating element 12, a lower heating element 14 and a control switch 16. The upper heating element 12 within the blanket encompasses substantially a major area of the blanket which is about seventy five percent thereof. It provides a uniform degree of heat over the body portion of the person when the upper heating element 12 is energized.

The lower heating element 14 within the blanket encompasses substantially a minor area of the blanket which is about twenty five percent thereof. It provides a uniform degree of heat over the feet portion of the person when the lower heating element 14 is energized.

The control switch 16 is operatively associated with the upper and lower heating elements 12 and 14. It can independently energize each of the upper and lower heating elements and also energize both upper and lower heating elements together.

A track 18 is built-in along top 20 of the blanket 10 so that the control switch 16 can engage the track. The control switch is slideably adjustable along the track 18 for easy access by the person using the control switch 16. The control switch is provided with a built-in prong plug 22 for attachment to a socket 24 on a wire 26 from a source of power 28.

Both of the heating elements 12 and 14 are provided with a combined but electrically independent prong plug 30 on a wire 32 for attachment to the source of power 28 through a built-in socket 34 in the control switch 16.

FIG. 5 shows a modification 10*a* in which both heating elements 12 and 14 are directly electrically connected through the track 18 and the control switch 16 to the source of power 28 via internal wiring 36 and 38.

The upper and lower heating elements 12 and 14 may each have individual switches (not shown) so not to confuse an elderly person. The control switch 16 may also have pictorial indicia 40 to indicate the body and feet so as also not to confuse the elderly person when operating the control switch.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An electric blanket for a person with arthritis and circulatory problems in their legs which comprises:

(a) an upper heating element within said blanket and encompassing substantially a major area of said blanket so as to provide a uniform degree of heat over a body portion of a person when said upper heating element is energized;

(b) lower heating element within said blanket and encompassing substantially a minor area of said blanket so as to provide a uniform degree of heat over feet portion of said person when said lower heating element is energized; and (c) a control switch operatively associated with said upper and lower heating elements so as to independently energize each of said upper and lower heating elements and to energize both upper and lower heating elements together further comprising a built-in track along top of said blanket so that said control switch can enegage said track to be slideably adjustable along said track for easy access by said person using said control switch.

2. An electric blanket as recited in claim 1, in which said control switch is provided with a built-in prong plug for attachment to a socket from a source of power.

3. An electric blanket as recited in claim 2, in which both said heating elements are provided with a combined but electrically independent prong plug for attachment to said source of power through a socket in said control switch.

4. An electric blanket as recited in claim 3, in which both said heating elements are directly electrically connected through said track and said control switch to said source of power.

* * * * *